US008020234B2

(12) United States Patent
Johnson et al.

(10) Patent No.: US 8,020,234 B2
(45) Date of Patent: Sep. 20, 2011

(54) COUNTERBALANCE MECHANISM FOR FOLD OUT RAMP

(75) Inventors: David Johnson, Modesto, CA (US); Alan Cohn, Lockeford, CA (US)

(73) Assignee: Lift-U, a division of Hogan Mfg., Inc., Escalon, CA (US)

( * ) Notice: Subject to any disclaimer, the term of this patent is extended or adjusted under 35 U.S.C. 154(b) by 11 days.

(21) Appl. No.: 12/754,467

(22) Filed: Apr. 5, 2010

(65) Prior Publication Data

US 2011/0088177 A1 Apr. 21, 2011

Related U.S. Application Data

(60) Provisional application No. 61/252,526, filed on Oct. 16, 2009.

(51) Int. Cl.
*E01D 1/00* (2006.01)

(52) U.S. Cl. ..... 14/71.3; 14/71.1; 74/53

(58) Field of Classification Search ..... 74/53, 567, 74/569, 603; 14/71.1, 71.3
See application file for complete search history.

(56) References Cited

U.S. PATENT DOCUMENTS

| | | | | |
|---|---|---|---|---|
| 1,444,924 | A * | 2/1923 | Larsh | 184/5 |
| 2,119,087 | A * | 5/1938 | Stout | 74/53 |
| 2,547,532 | A | 4/1951 | Mendelsohn | |
| 4,081,091 | A | 3/1978 | Thorley | |
| 4,274,172 | A | 6/1981 | Franklin | |
| 4,365,374 | A | 12/1982 | Bennett | |
| 4,499,970 | A | 2/1985 | Hussey | |
| 4,503,722 | A | 3/1985 | Suzuki | |
| 4,525,887 | A | 7/1985 | Erlandsson | |
| 4,550,623 | A | 11/1985 | Gysling | |
| 4,571,775 | A | 2/1986 | Leonard | |
| 4,621,391 | A | 11/1986 | Leonard | |
| 4,627,784 | A | 12/1986 | Collins | |

(Continued)

FOREIGN PATENT DOCUMENTS

DE 44 13 444 A1 10/1995

(Continued)

OTHER PUBLICATIONS

Fall Protection Systems, Inc. <retrieved on Jul. 14, 2009 from: http://www.fallprotectionsystems.com/access_systems.html>.

(Continued)

*Primary Examiner* — Gary S Hartmann
(74) *Attorney, Agent, or Firm* — Christensen O'Connor Johnson Kindness PLLC

(57) ABSTRACT

A ramp assembly includes a ramp portion configured for reciprocating motion between a stowed position, a deployed position, and a neutral position. The ramp assembly further includes a counterbalance that provides a force to bias the ramp portion toward the stowed position when the ramp portion is between the deployed position and the neutral position, and toward the deployed position when the ramp portion is between the stowed position and the neutral position. A shaft rotates in a first direction when the ramp portion moves toward the stowed position, and in a second direction opposite the first direction when the ramp portion moves toward the deployed position. A crank is fixedly coupled to the shaft. A rod is rotatably coupled at a first end to the crank about a first axis and at a second end to a cylinder. The cylinder is coupled for rotational movement about a second axis.

9 Claims, 6 Drawing Sheets

U.S. PATENT DOCUMENTS

| | | | | |
|---|---|---|---|---|
| 4,657,233 | A | 4/1987 | Vroom | |
| 4,665,579 | A | 5/1987 | Bennett | |
| 4,691,956 | A | 9/1987 | Hodge | |
| 4,797,042 | A | 1/1989 | McFarland | |
| 4,836,736 | A | 6/1989 | Neagu | |
| 4,873,791 | A | 10/1989 | Lyons, Sr. | |
| 4,907,936 | A | 3/1990 | Bourdage | |
| 4,922,568 | A * | 5/1990 | Hageman | 14/71.3 |
| 4,950,124 | A | 8/1990 | Burghart | |
| 5,040,936 | A | 8/1991 | Rhea | |
| 5,085,555 | A | 2/1992 | Vartanian | |
| 5,145,310 | A | 9/1992 | Calzone | |
| 5,224,722 | A | 7/1993 | Kempf | |
| 5,253,410 | A | 10/1993 | Mortenson | |
| 5,306,113 | A | 4/1994 | Mann | |
| 5,316,432 | A | 5/1994 | Smalley | |
| 5,358,301 | A | 10/1994 | Konchan | |
| 5,375,962 | A | 12/1994 | Kempf | |
| 5,391,041 | A | 2/1995 | Stanbury | |
| 5,392,481 | A | 2/1995 | Hageman | |
| 5,449,267 | A | 9/1995 | Ablabutyan | |
| 5,865,593 | A | 2/1999 | Cohn | |
| 5,871,329 | A | 2/1999 | Tidrick | |
| 5,988,724 | A | 11/1999 | Wolda | |
| 6,010,298 | A | 1/2000 | Cohn | |
| 6,112,353 | A | 9/2000 | Winter | |
| 6,125,491 | A | 10/2000 | Alexander | |
| 6,196,609 | B1 | 3/2001 | Bowers | |
| 6,203,265 | B1 | 3/2001 | Cohn | |
| 6,205,606 | B1 * | 3/2001 | Zibella et al. | 14/71.3 |
| 6,210,098 | B1 | 4/2001 | Cohn | |
| 6,238,168 | B1 | 5/2001 | Cohn | |
| 6,409,458 | B1 | 6/2002 | Cohn | |
| 6,602,041 | B2 | 8/2003 | Lewis | |
| 6,647,898 | B2 * | 11/2003 | Li | 105/458 |
| 6,718,886 | B2 | 4/2004 | Engle | |
| 6,769,149 | B2 | 8/2004 | Alexander | |
| 6,843,635 | B2 | 1/2005 | Cohn | |
| 6,964,445 | B1 | 11/2005 | Bellis, Jr. | |
| 6,988,289 | B2 | 1/2006 | Pedersen | |
| 7,017,220 | B2 * | 3/2006 | Alexander et al. | 14/69.5 |
| 7,029,050 | B1 | 4/2006 | Johnson | |
| 7,156,441 | B2 | 1/2007 | Austin | |
| 7,213,286 | B2 * | 5/2007 | Hoofard et al. | 14/71.1 |
| 7,228,582 | B1 | 6/2007 | Jones | |
| 7,264,433 | B2 | 9/2007 | Navarro | |
| 7,353,558 | B2 | 4/2008 | Alexander | |
| 7,500,818 | B1 | 3/2009 | Johnson | |
| 7,533,432 | B2 * | 5/2009 | Morris et al. | 14/71.3 |
| 7,533,433 | B2 * | 5/2009 | Morris et al. | 14/71.3 |
| 7,533,434 | B2 * | 5/2009 | Morris et al. | 14/71.3 |
| 7,681,272 | B2 * | 3/2010 | Morris et al. | 14/71.3 |
| 2002/0197141 | A1 | 12/2002 | Cohn | |
| 2004/0096304 | A1 | 5/2004 | Lewis | |
| 2004/0136820 | A1 | 7/2004 | Cohn | |
| 2008/0006105 | A1 | 1/2008 | Ko | |
| 2008/0271267 | A1 * | 11/2008 | Morris et al. | 14/71.1 |
| 2008/0271268 | A1 | 11/2008 | Johnson | |
| 2008/0271269 | A1 * | 11/2008 | Morris et al. | 14/71.1 |
| 2009/0271934 | A1 * | 11/2009 | Morris et al. | 14/71.3 |

FOREIGN PATENT DOCUMENTS

| | | | |
|---|---|---|---|
| DE | 297 07 803 | U1 | 10/1997 |
| DE | 102004048761 | A1 | 4/2006 |
| EP | 0875421 | A1 | 11/1998 |
| EP | 1 844 980 | A2 | 4/2007 |
| GB | 585917 | | 2/1947 |
| GB | 2 116 940 | A | 10/1983 |
| GB | 2 274 092 | A | 7/1994 |
| GB | 2274092 | A | 7/1994 |
| GB | 2 306 152 | A | 4/1997 |
| GB | 2369344 | A | 5/2002 |
| JP | 07-108867 | | 4/1995 |
| JP | 2001-239888 | | 9/2001 |
| JP | 2008-230270 | | 10/2008 |
| WO | 0147746 | A1 | 7/2001 |

OTHER PUBLICATIONS

K&K Material Handling <retrieved on Jul. 16, 2009 from: http://www.knkmaterialhandling.com/Dock/Frame_DockProducts.htm>.

* cited by examiner

COUNTERBALANCE MECHANISM FOR FOLD OUT RAMP

BACKGROUND

The Americans with Disabilities Act (ADA) requires the removal of physical obstacles to those who are physically challenged. The stated objective of this legislation has increased public awareness and concern over the requirements of the physically challenged. Consequentially, there has been more emphasis in providing systems that assist such a person to access a motor vehicle, such as a bus or minivan.

A common manner of providing the physically challenged with access to motor vehicles is a ramp. Various ramp operating systems for motor vehicles are known in the art. Some slide out from underneath the floor of the vehicle and tilt down. Others are stowed in a vertical position and are pivoted about a hinge, while still others are supported by booms and cable assemblies. The present invention is generally directed to a "fold out" type of ramp. Such a ramp is normally stowed in a horizontal position within a recess in the vehicle floor, and is pivoted upward and outward to a downward-sloping extended position. In the extended position, the ramp is adjustable to varying curb heights.

Fold out ramps on vehicles confront a variety of technical problems. Longer ramps are desirable because the resulting slope is more gradual and more accessible by wheelchair-bound passengers. Longer ramps are, however, heavier and require more torque about the hinge to be reciprocated between deployed and stowed positions. To satisfy this torque requirement, such fold-out ramps use large electric motors, pneumatic devices, or hydraulic actuators to deploy and stow the ramp. Many of such systems cannot be moved manually in the event of failure of the power source unless the drive mechanism is first disengaged. Some existing fold-out ramps can be deployed or stowed manually, but they are difficult to operate because one must first overcome the resistance of the drive mechanism.

As noted above, many existing fold-out ramps are equipped with hydraulic, electric, or pneumatic actuating devices. Such devices are obtrusive and make access to and from a vehicle difficult when the ramp is stowed. Moreover, many of such fold-out ramps have no energy storage capabilities to aid the lifting of the ramp, and thereby preserve the life of the drive motor or even allow a smaller drive to be employed. Finally, operating systems for such fold-out ramps must have large power sources to overcome the torque placed on the hinge by the necessarily long moment arm of the fold-out ramp.

SUMMARY

A first ramp assembly includes a ramp portion configured for reciprocating motion between a stowed position, a deployed position, and a neutral position. The ramp assembly further includes a counterbalance having a shaft configured to rotate (1) in a first direction when the ramp portion moves toward the stowed position, and (2) in a second direction opposite the first direction when the ramp portion moves toward the deployed position. A crank is fixedly coupled to the shaft, and a rod is rotatably coupled at a first end to the crank about a first axis. The first axis moves along an arcuate path when the ramp portion reciprocates between the stowed position and the deployed position. A cylinder is coupled to a second end of the rod and is coupled for rotational movement about a second axis. The second axis has a fixed location relative to the neutral position of the ramp portion. The cylinder provides a force to bias the ramp portion toward the stowed position when the ramp portion is between the deployed position and the neutral position, and toward the deployed position when the ramp portion is between the stowed position and the neutral position.

A second ramp assembly has a ramp portion configured for reciprocating motion between a stowed position, a deployed position, and a neutral position. The ramp assembly also has a counterbalance, which includes a pin that moves along an arcuate path when the ramp portion moves between the stowed position and the deployed position moves the pin. The counterbalance further includes a rod and an end fitting coupled to a first end of the rod. The end fitting includes a recess for engaging the pin. A cylinder is coupled to a second end of the rod and is also coupled for rotational movement about an axis having a fixed location relative to the neutral position of the ramp portion. The cylinder provides a force to maintain engagement of the pin to the recess and to bias the ramp portion toward the stowed position when the ramp portion is between the deployed position and the neutral position, and toward the deployed position when the ramp portion is between the stowed position and the neutral position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Exemplary embodiments of the present invention will now be described with reference to the accompanying drawings where like numerals correspond to like elements. Exemplary embodiments of the disclosed subject matter are directed to ramp assemblies, and in particular, to wheelchair ramp assemblies. In particular, described embodiments are directed to wheelchair ramp assemblies suitable for use in buses, vans, etc.

The following discussion proceeds with reference to examples of wheelchair ramp assemblies for use in vehicles having a floor, such as a bus, van, etc. While the examples provided herein have been described with reference to their association with vehicles, it will be apparent to one skilled in the art that this is done for illustrative purposes and should not be construed as limiting the scope of the claimed subject matter. Thus, it will be apparent to one skilled in the art that aspects of the present disclosure may be employed with other ramp assemblies used in stationary installations, such as residential buildings and the like.

When a ramp assembly is installed in a vehicle, some components of the ramp assembly may maintain a fixed relationship relative to the vehicle structure, while other components move relative to the vehicle structure when the ramp reciprocates between a stowed position and a deployed position. Similarly, when a ramp assembly is installed in a stationary installation, such as a residential building and the like, some components of the ramp assembly may maintain a fixed relationship relative to the building structure, while other components move relative to the building structure when the ramp reciprocates between a stowed position and a deployed position.

The following detailed description may use illustrative terms such as vertical, horizontal, front, rear, roadside, curbside, proximal, distal, etc. However, these terms are descriptive in nature and should not be construed as limiting. Further, it will be appreciated that embodiments of the present disclosure may employ any combination of features described herein.

Figure 1:
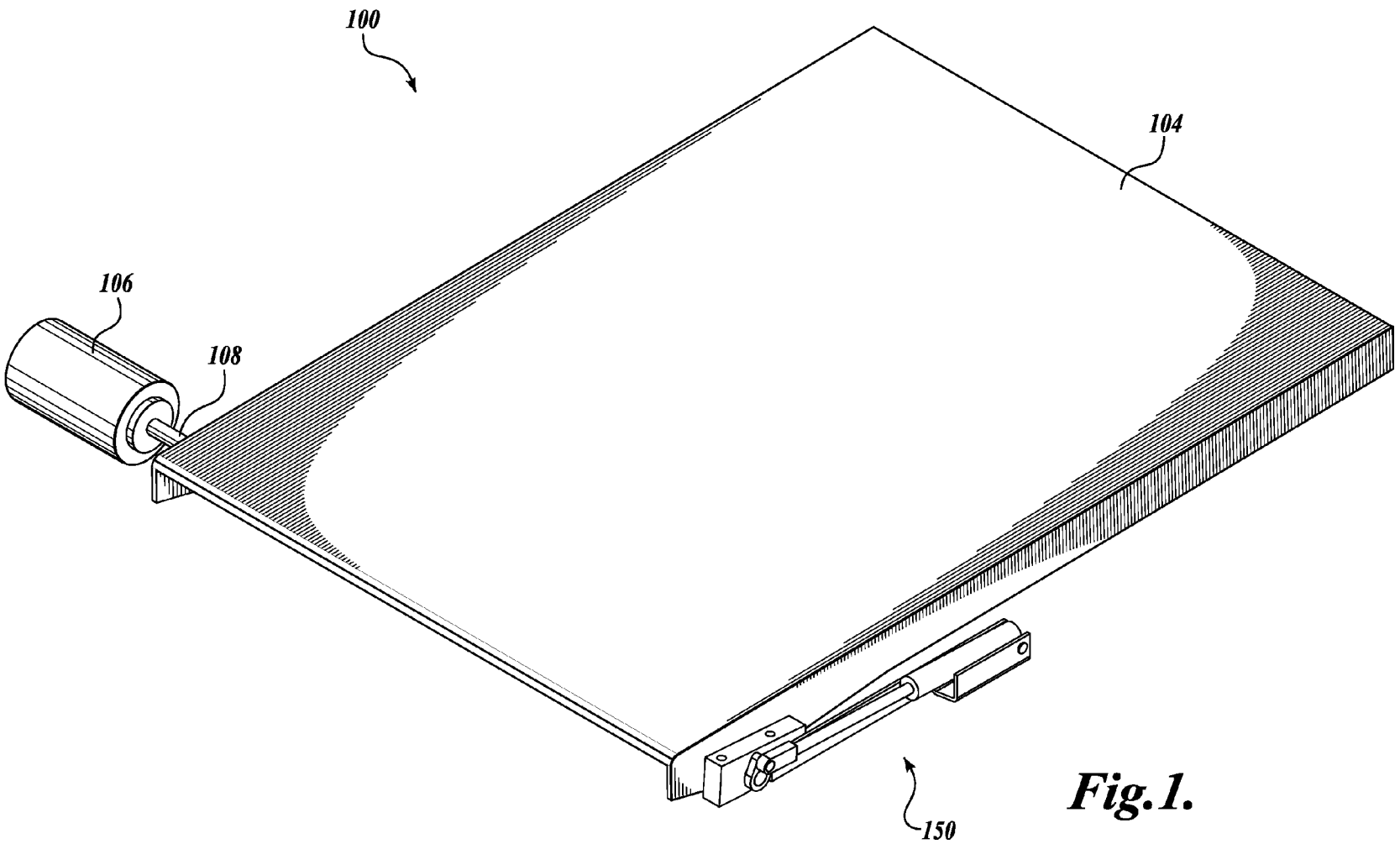
FIG. 1 shows an isometric view of a fold out ramp having a first embodiment of a counterbalance mechanism, wherein a ramp portion is shown in the stowed position.
Figure 2:
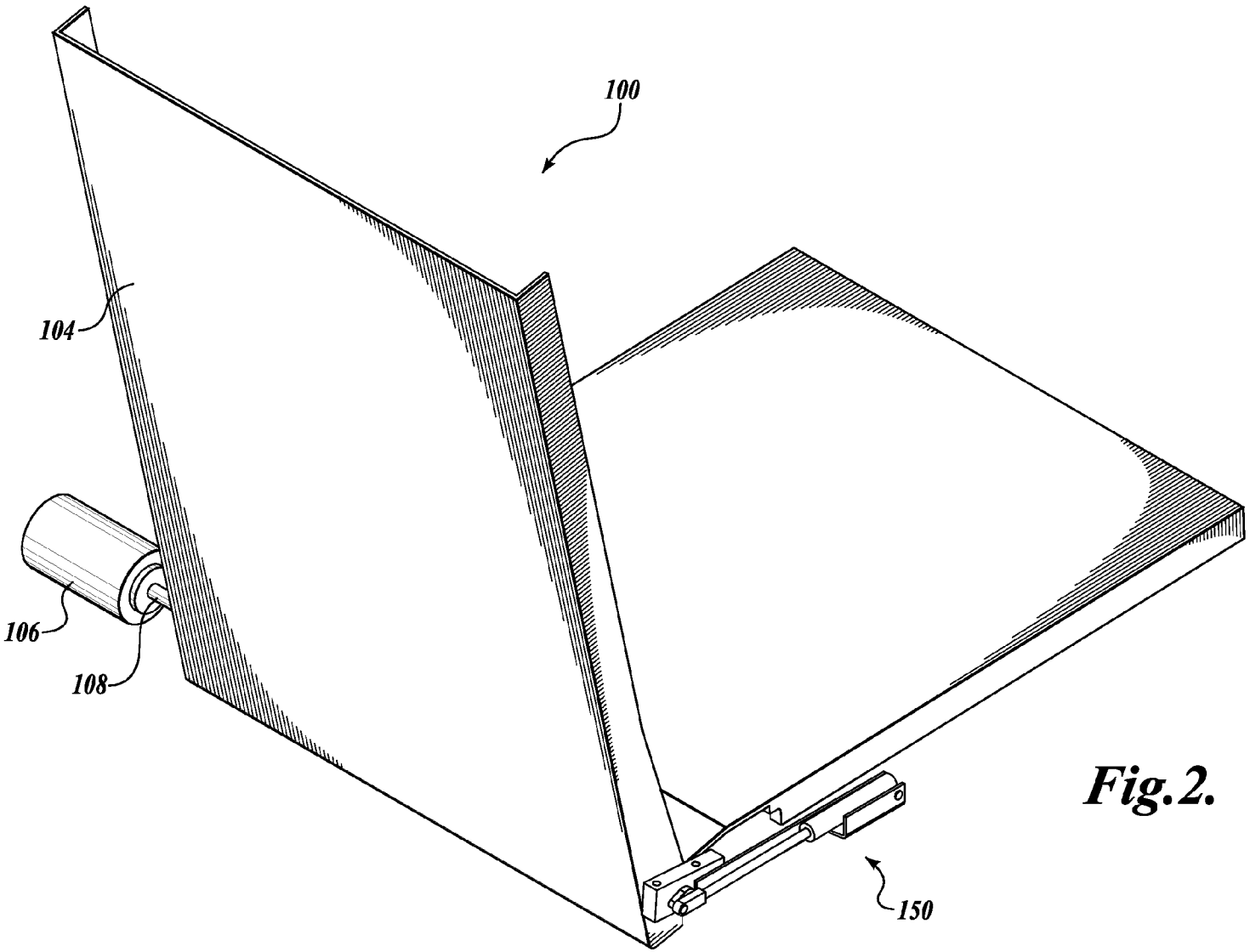
FIG. 2 shows an isometric view of the fold out ramp of FIG. 1 with the ramp portion in a position between the stowed position and a deployed position.
Figure 3:
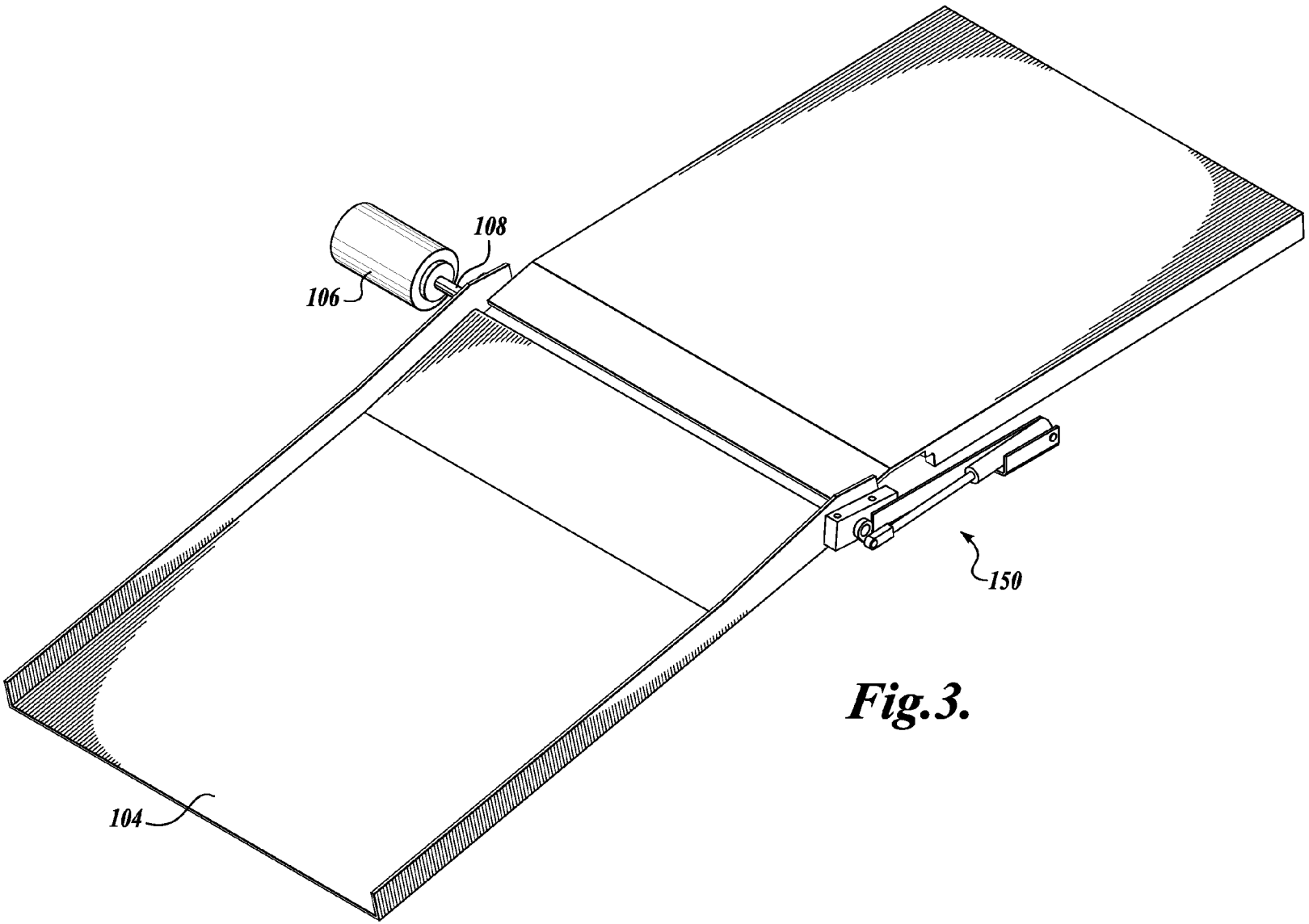
FIG. 3 shows an isometric view of the fold out ramp of FIG. 1 with the ramp portion in a deployed position.

FIGS. 1-3 illustrate an exemplary embodiment of a fold out ramp assembly 100 (hereinafter the "ramp assembly 100") suitable for use with the described counterbalance assemblies. The ramp assembly 100 includes a ramp portion 104. The ramp assembly 100 is adapted to be mounted to a vehicle (not shown), such as a bus or a van. One end of the ramp portion 104 is rotatably attached to the ramp assembly 100 so that the ramp portion 104 is reciprocal between the stowed position, as shown in FIG. 1, and a deployed position, as shown in FIG. 3. A motor 106 is operatively coupled to the ramp portion 104 with a drive shaft 108 to reciprocate the ramp portion 104 between the stowed position and a deployed position.

Figure 4:
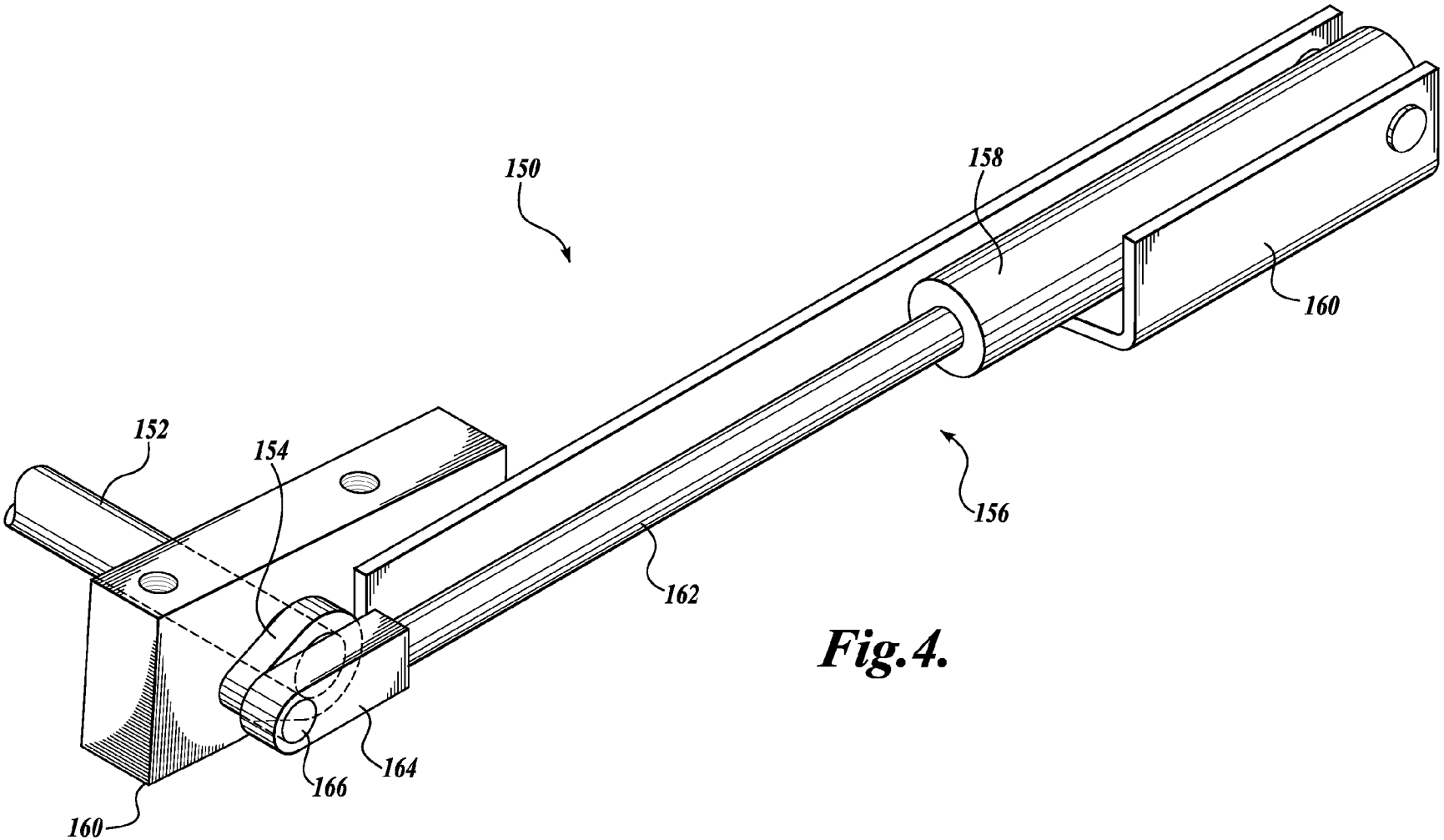
FIG. 4 shows an isometric view of the counterbalance assembly of FIG. 1 when the ramp portion is in the neutral position.

FIGS. 4-7 show a first exemplary embodiment of a counterbalance assembly 150. As best shown in FIG. 4, the counterbalance assembly 150 includes an output shaft 152 that rotates in a first direction when the ramp portion 104 moves toward the stowed position and in a second direction when the ramp portion 104 moves toward a deployed position. A crank 154 is attached to the output shaft 152 so that the crank 154 rotates with the output shaft 152. In the illustrated embodiment, the center of rotation of the ramp portion 104 is coincident to the axis of the output shaft 152; however, one of ordinary skill in the art would recognize that the location and orientation of the output shaft 152 can differ with the inclusion of various known transmission elements to couple the output shaft 152 to the ramp portion 104. In yet another embodiment, the driveshaft 108 that couples the motor 106 to the ramp portion 104 can act as an output shaft 152, i.e., the shaft to which the counterbalance 150 is attached. For ramp assemblies 100 having the motor 106 located in an internal portion of the ramp assembly, such a configuration would allow the counterbalance assembly to be located internal to the ramp assembly 100 also, i.e. under the ramp portion 104 when the ramp portion is in the stowed position. It should be appreciated that the output shaft 152 can be any shaft associated with the ramp assembly 100 that rotates in a first direction when the ramp portion 104 moves toward the stowed position and in a second direction when the ramp portion moves toward a deployed position.

A resistance member 156 provides a resistive force to counteract the tendency of the ramp portion 104 to rotate due to the weight W of the ramp portion 104. The illustrated resistance member 156 includes a cylinder 158 pivotally attached to a portion 160 of the ramp assembly 100 that maintains a fixed position relative to the neutral position of the ramp portion 104 i.e., to a fixed portion of the ramp assembly 100. The cylinder 158 of the illustrated embodiment can be a pneumatic cylinder, i.e., a gas spring, or a hydraulic cylinder. It should be appreciated that the cylinder 158 may also be pivotally coupled to a component of the vehicle that maintains a fixed position relative to neutral position of the ramp portion.

A rod 162 slidably engages the cylinder 158 so that a first end of the rod 162 is disposed within the cylinder 158. The second end of the rod 162 extends from the cylinder 158 and is rotatably coupled to the crank 154 so that rotation of the crank 152 causes the second end of the rod 162 to travel along a predetermined arcuate path. In the illustrated embodiment, an end fitting 164 is coupled to the second end of the rod, and a pin 166 is disposed on the crank 154. The pin 166 engages a hole formed in the end fitting 164 to rotatably couple the end fitting 164, and therefore the rod 162, to the crank 154. It is contemplated that a variety of alternate configurations are possible to rotatably couple the rod 162 to the crank 154, and such configurations should be considered within the scope of the present disclosure.

As the second end of the rod 162 travels along the predetermined arcuate path, the cylinder 158 pivots relative to the neutral position of the ramp portion 104. At the same time, the rod 162 reciprocates into and out of the cylinder 158 in response to the change in distance between the cylinder pivot and the pivotal connection of the rod 162 to the crank 154. The cylinder 158 resists movement of the rod 162 into the cylinder.

Figure 5:
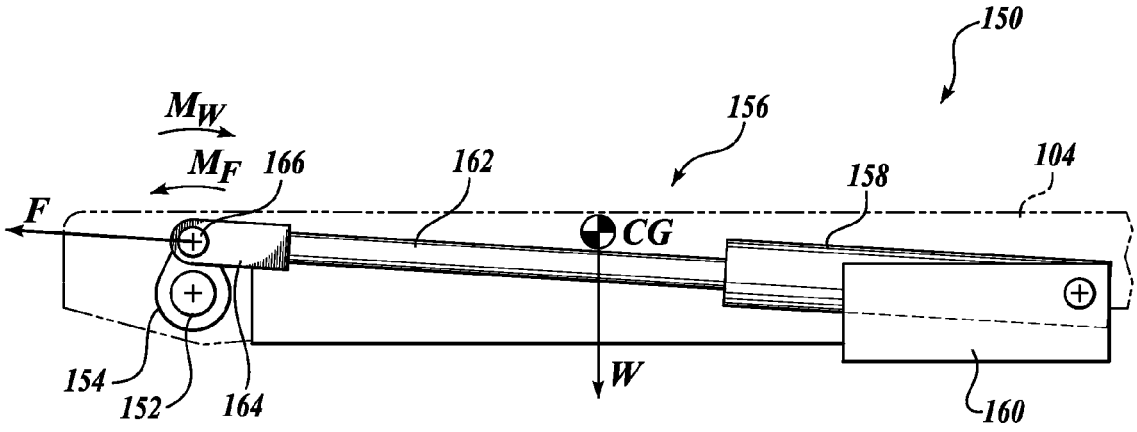
FIG. 5 shows a side view of the counterbalance assembly of FIG. 4, with the ramp portion in the stowed position.
Figure 6:
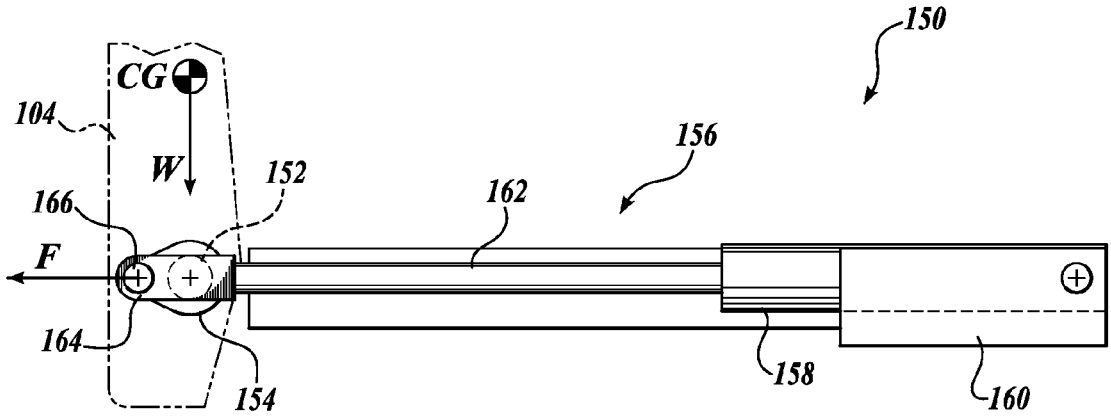
FIG. 6 shows a side view of the counterbalance assembly of FIG. 4, with the ramp portion in the neutral position.
Figure 7:
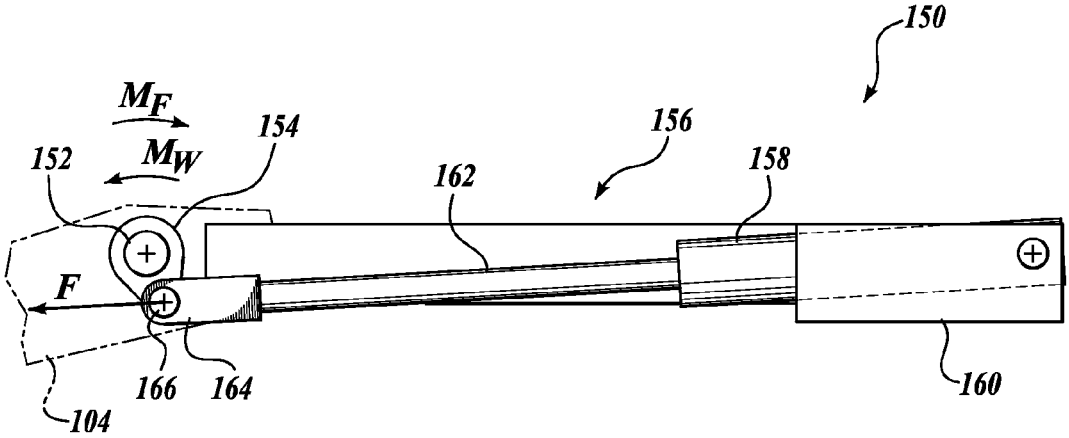
FIG. 7 shows a side view of the counterbalance assembly of FIG. 4, with the ramp portion in a deployed position.

FIGS. 5-7 show the ramp assembly 100 as the ramp portion 104 rotates from the stowed position (FIG. 5) through a neutral position (FIG. 6) to a deployed position (FIG. 7). Referring to FIG. 5, when the ramp is in the stowed position, the weight W of the ramp portion 104, which is idealized as a point force acting at the CG of the ramp portion 104, imparts a moment $M_W$ about the center of rotation of the ramp portion 104. Because the CG is located roadside of the center of rotation of the ramp portion 104, the moment $M_W$ tends to rotate the ramp portion 104 toward the stowed position, i.e., away from the neutral position. The moment $M_W$ is the product of the weight W of the ramp portion 104 multiplied by moment arm, which is the horizontal distance between (1) the center of rotation of the ramp portion and (2) the CG of the ramp portion. As the ramp portion moves from the stowed position toward the neutral position, the moment arm decreases, and thus, the moment $M_W$ tending to rotate the ramp toward the stowed position is reduced.

Referring to FIG. 6, when the ramp portion 104 is in the neutral position, the CG of the ramp portion 104 is directly above the center of rotation of the ramp portion so that moment arm is zero. Accordingly, the weight W of the ramp portion 104 does not impart a moment $M_W$ on the ramp portion 104 when the ramp portion is in the neutral position.

When the ramp portion 104 is located between the neutral position and a deployed position, the CG of the ramp portion is located curbside of the center of rotation of the ramp portion 104. Consequently, the weight W of the ramp portion 104 imparts a moment $M_W$ that tends to move the ramp portion farther away from the stowed position. As the ramp portion moves from the neutral position to a deployed position, the moment arm and, therefore, the moment $M_W$ increase until the ramp portion is approximately horizontal. As the ramp portion 104 continues to travel from the approximately horizontal position to its final deployed position, the moment arm, and thus the moment $M_W$, decrease slightly.

As the ramp portion 104 reciprocates between the stowed position and a deployed position, the resistance member 156 applies a force F that pushes on the crank 122 to create a moment $M_F$ about the center of rotation of the ramp portion 104. The moment $M_F$ counteracts the moment $M_W$ that results from the weight W of the ramp portion 104 when the ramp portion 104 is in a position other than the neutral position.

Referring to FIGS. 5 and 7, when the ramp portion 104 is between the stowed position and the neutral position or between a deployed position and the neutral position, the moment $M_F$ imparted by the resistance member 156 tends to rotate the ramp portion 104 toward the neutral position. As the ramp portion 104 rotates toward the neutral position from either the stowed position or a deployed position, the line of action of the force F rotates toward the center of rotation of the output shaft 152, thereby reducing the distance between the line of action and the center of rotation of the crank 122, i.e., the moment arm of $M_F$. Consequently, like the moment $M_W$, the moment $M_F$ applied to the shaft 152 decreases as the ramp portion 104 approaches the neutral position.

As shown in FIG. 6, when the ramp portion 104 is in the neutral position, i.e., when the weight W of the ramp portion 104 is directly above the center of rotation of the ramp portion so that that weight W does not impart a moment $M_W$ on the ramp portion 104, the force F acts through the center of rotation of the shaft 152. Accordingly, no moment $M_F$ is imparted by the resistance member 156 when the ramp portion 104 is in the neutral position.

The resistance member preferably supplies a force F of a magnitude such that $M_F$ approximates $M_W$ as the ramp portion reciprocates between the stowed position and a deployed position, thereby minimizing the difference between $M_F$ and $M_W$. Minimizing the difference between $M_F$ and $M_W$ in this manner reduces the output requirement on the motor 106, allowing for a smaller, more compact motor. Manual operation effort is also reduced.

Figure 8:
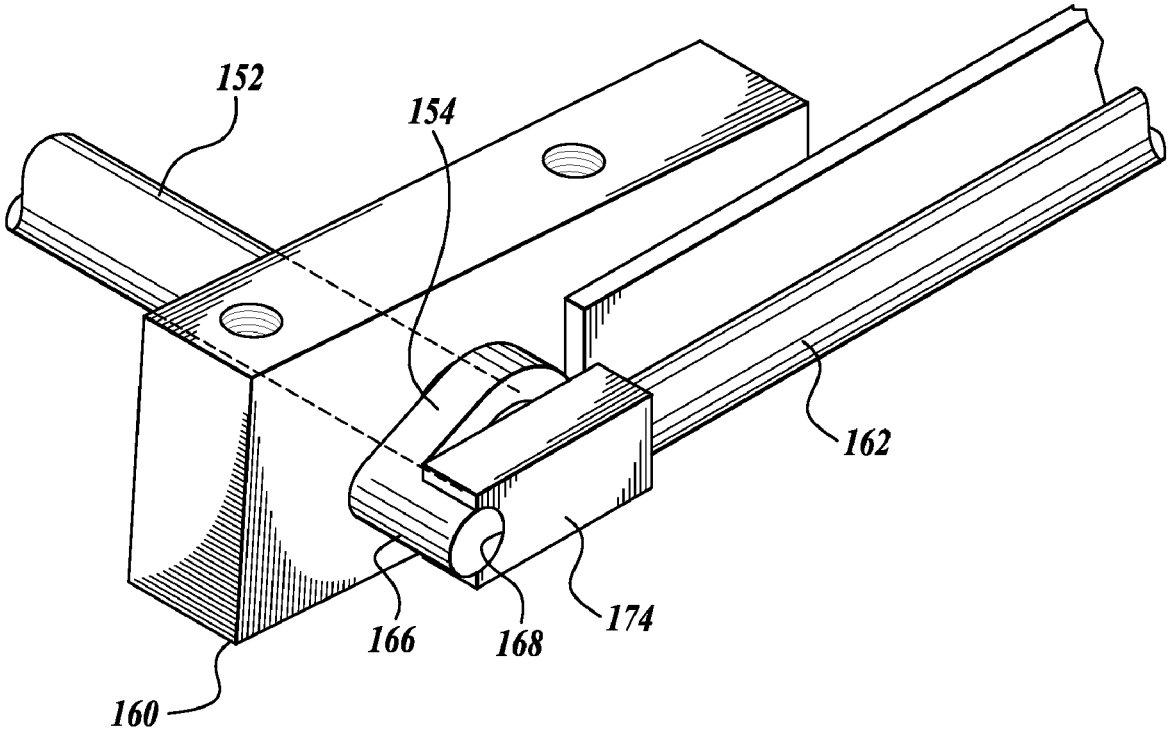
FIG. 8 shows an isometric view of a second exemplary embodiment of an end fitting of the counterbalance assembly of FIG. 4.

FIG. 8 shows an alternate embodiment of the end fitting 164 shown in FIGS. 4-7. Unlike the end fitting 164 shown in FIGS. 4-7, the end fitting 174 of FIG. 8 does not include a hole for engaging the pin 166 associated with the crank 154. Instead, the end fitting 174 has a recess 168 formed therein to engage the pin 166. The recess 168 is located such that force F provide by the resistance member 156 maintains the engagement of the pin 166 with the recess 168 as the ramp portion 104 reciprocates between the stowed position and a deployed position. Because the end fitting 164 does not surround the pin 166, the pin resistance member 156 can be disengaged from the crank 174 by manually applying an axial force to the rod 162 that disengages the pin 166 from the recess and rotating the resistance member 156 away from the pin 166. Similarly, the resistance member 156 can be engaged with the crank 174 by (1) applying the a force to the rod 162 that moves the rod into the cylinder 158, (2) rotating the resistance member to align the recess 168 with the pin 166, and (3) releasing the rod 162 so that the pin engages the recess, thus rotatably coupling the resistance member 156 to the crank 174.

While illustrative embodiments have been illustrated and described, it will be appreciated that various changes can be made therein without departing from the spirit and scope of the invention.

The embodiments of the invention in which an exclusive property or privilege is claimed are defined as follows:

1. A ramp assembly, comprising:

(a) a ramp portion configured for reciprocating motion about a center of rotation between a stowed position, a deployed position, and a neutral position, wherein the ramp portion has a center of gravity, the center of gravity being located directly above the center of rotation when the ramp portion is in the neutral position; and (b) a counterbalance associated with the ramp portion, comprising:

(i) a shaft configured to rotate (1) in a first direction when the ramp portion moves toward the stowed position, and (2) in a second direction opposite the first direction when the ramp portion moves toward the deployed position;

(ii) a crank fixedly coupled to the shaft;

(iii) a rod having a first end rotatably coupled to the crank about a first axis, the first axis moving along an arcuate path when the ramp portion reciprocates between the stowed position and the deployed position; and (iv) a cylinder coupled to a second end of the rod and coupled for rotational movement about a second axis, the second axis having a fixed location relative to the neutral position of the ramp portion, wherein the cylinder provides a force, (1) the force biasing the ramp portion toward the stowed position when the ramp portion is between the deployed position and the neutral position, and (2) the force biasing the ramp portion toward the deployed position when the ramp portion is between the stowed position and the neutral position.

2. The ramp assembly of claim 1, wherein movement of the ramp portion toward the stowed position rotates the cylinder in a first direction, and movement of the ramp portion toward the deployed position rotates the cylinder in a second direction.

3. The ramp assembly of claim 1, wherein the cylinder is a pneumatic cylinder.

4. The ramp assembly of claim 1, wherein the cylinder is a hydraulic cylinder.

5. The ramp assembly of claim 1, wherein the force provided by the cylinder does not bias the ramp portion when the ramp portion is in the neutral position.

6. A ramp assembly, comprising:

(a) a ramp portion configured for reciprocating motion about a center of rotation between a stowed position, a deployed position, and a neutral position, wherein the ramp portion has a center of gravity, the center of gravity being located directly above the center of rotation when the ramp portion is in the neutral position; and (b) a counterbalance associated with the ramp portion, comprising:

(i) a pin, wherein movement of the ramp portion between the stowed position and the deployed position moves the pin along an arcuate path;

(iii) a rod;

(iv) an end fitting coupled to a first end of the rod, wherein the end fitting includes a recess for engaging the pin;

(iv) a cylinder coupled to a second end of the rod and coupled for rotational movement about an axis having a fixed location relative to the neutral position of the ramp portion, wherein the cylinder provides a force to maintain engagement of the pin to the recess, (1) the force biasing the ramp portion toward the stowed position when the ramp portion is between the deployed position and the neutral position, and (2) the force biasing the ramp portion toward the deployed position when the ramp portion is between the stowed position and the neutral position.

7. The ramp assembly of claim 6, wherein movement of the ramp portion toward the stowed position rotates the cylinder in a first direction, and movement of the ramp portion toward the deployed position rotates the cylinder in a second direction.

8. The ramp assembly of claim 6, wherein the cylinder is a pneumatic cylinder.

9. The ramp assembly of claim 6, wherein the cylinder is a hydraulic cylinder.

* * * * *